US010000361B2

(12) United States Patent
Liu

(10) Patent No.: US 10,000,361 B2
(45) Date of Patent: Jun. 19, 2018

(54) HOSE WINDING DEVICE

(71) Applicant: Fred Liu, Tainan (TW)

(72) Inventor: Fred Liu, Tainan (TW)

( * ) Notice: Subject to any disclaimer, the term of this patent is extended or adjusted under 35 U.S.C. 154(b) by 75 days.

(21) Appl. No.: 15/236,059

(22) Filed: Aug. 12, 2016

(65) Prior Publication Data

US 2018/0044131 A1 Feb. 15, 2018

(51) Int. Cl.
*B65H 75/40* (2006.01)
*B65H 75/44* (2006.01)

(52) U.S. Cl.
CPC ..... *B65H 75/4494* (2013.01); *B65H 75/403* (2013.01); *B65H 2701/33* (2013.01)

(58) Field of Classification Search
CPC ..... B65H 75/403; B65H 75/4494; B65H 2701/33
See application file for complete search history.

(56) References Cited

U.S. PATENT DOCUMENTS 4,974,627 A * 12/1990 Nelson ..... B65H 75/403 137/355.2
9,808,839 B2 * 11/2017 Liu ..... B65H 75/42
2004/0188558 A1 * 9/2004 Moon ..... B65H 75/403 242/403.1
2009/0166463 A1 * 7/2009 Mosher ..... B65H 75/403 242/403.1

* cited by examiner

*Primary Examiner* — Sang K Kim

(57) ABSTRACT

A hose winding device includes a rotating wheel rotatably mounted to a frame. A hose is wound around the rotating wheel. The rotating wheel is rotated when the hose is pulled outward. An axle of the frame is received in a rotating shaft and a connecting shaft. An arm is fixed between the connecting shaft and a handle. A connecting rod is configured to securely couple the rotating shaft and the connecting shaft with the axle. An elastic element biases the connecting shaft to engage with the rotating shaft, permitting joint rotation of the connecting shaft and the rotating shaft in a first direction. The connecting shaft moves along a longitudinal axis of the rotating shaft when the connecting shaft and the rotating shaft are subjected to a torque in a second direction reverse to the first direction, and the connecting shaft disengages from the rotating shaft.

5 Claims, 5 Drawing Sheets

A - A

HOSE WINDING DEVICE

BACKGROUND OF THE INVENTION

The present invention relates to a hose winding device and, more particularly, to a hose winding device with improved use safety and improved assembling convenience.

A conventional hose winding device includes a frame that can be placed on the ground. A rotating wheel is mounted to the frame and is connected to a handle. A hose is wound around the rotating wheel. The hose can be connected to a water source. In use, a water outlet end of the hose is pulled to a position for outputting water. After use, the handle is rotated to rotate the rotating wheel, thereby winding the hose. However, the rotating wheel and the handle are also rotated while the water outlet end of the hose is being pulled outward. A person near the handle could be hit and injured by the rotating handle.

Thus, a need exists for a novel hose winding device that mitigates and/or obviates the above disadvantages.

BRIEF SUMMARY OF THE INVENTION

An objective of the present invention is to provide a hose winding device with improved use safety and improved assembling convenience.

A hose winding device according to the present invention includes a frame adapted to be mounted on a ground. The frame includes an axle. A rotating wheel includes a shaft rotatably mounted to the frame. A hose is adapted to be wound around the rotating wheel. The rotating wheel is rotated when the hose is pulled outward. A handle transmission unit is connected to and jointly rotatable with the rotating wheel. The handle transmission unit includes a rotating shaft, a connecting shaft, an arm, a handle, a connecting rod, and an elastic element. The rotating shaft includes a through-hole. The axle of the frame is received in the through-hole of the rotating shaft. The rotating shaft is connected to and jointly rotatable with the axle of the rotating wheel. The rotating shaft includes an end having a plurality of engaging grooves annularly spaced from each other. Each of the plurality of engaging grooves includes a first rectilinear surface extending in a direction parallel to a longitudinal axis of the rotating shaft. Each of the plurality of engaging grooves further includes a first inclined surface opposite to the first rectilinear surface. The connecting shaft is coaxially mounted to an outer side of the rotating shaft and includes a through-hole receiving the axle of the frame. The connecting shaft includes an inner end having a plurality of protrusions annularly spaced from each other. Each of the plurality of protrusions includes a second rectilinear surface extending in a direction parallel to the longitudinal axis of the rotating shaft and corresponding to one of the plurality of engaging grooves. Each of the plurality of protrusions further includes a second inclined surface opposite to the second rectilinear surface and corresponding to one of the plurality of first inclined surfaces. The arm includes a first end fixed to the connecting shaft and a second end fixed to the handle. The connecting rod is configured to securely couple the through-holes of the rotating shaft and the connecting shaft with the axle. The elastic element biases the plurality of protrusions of the connecting shaft to engage with the plurality of engaging grooves of the rotating shaft, permitting joint rotation of the connecting shaft and the rotating shaft in a first direction. The connecting shaft moves along the longitudinal axis of the rotating shaft when the first and second inclined surfaces are subjected to a torque in a second direction reverse to the first direction, and the plurality of protrusions of the connecting shaft disengages from the plurality of engaging grooves of the rotating shaft.

In an example, the connecting rod includes an inner end coupled with the axle of the frame. The connecting rod further includes an outer end having a stopper portion. The first end of the arm is located between the axle and the stopper portion. The elastic element is mounted around the connecting rod and is located between the stopper portion and the first end of the arm.

In an example, the axle of the frame includes a receptacle having an inner periphery with a retaining groove. The connecting rod includes a plurality of positioning balls. The inner end of the connecting rod is received in the receptacle. The plurality of positioning balls is coupled in the retaining groove.

In an example, the handle transmission unit further includes a first transmission wheel, a second transmission wheel, and a transmission belt. The first transmission wheel is coupled to and jointly rotatable with the shaft of the rotating wheel. The second transmission wheel is mounted above the first transmission wheel and is coupled to and jointly rotatable with the rotating shaft. The transmission belt is mounted around the first and second transmission wheels to permit joint rotation of the first and second transmission wheels.

In an example, the first end of the arm extends substantially perpendicularly to an outer end of the connecting shaft. The arm includes a through-hole aligned with the through-hole of the connecting shaft. The connecting rod includes a housing having a receiving hole. The connecting rod further includes an outer end having a stopper portion with an outer diameter larger than a diameter of the through-hole of the arm. An actuating rod and a spring are mounted in the receiving hole. The housing includes an outer periphery having a plurality of grooves. A plurality of positioning balls is respectively received in the plurality of grooves of the housing. The actuating rod includes an inner end having a plurality of projections and a plurality of recesses for receiving the plurality of positioning balls. The actuating rod further includes an outer end located outside of the housing. The spring biases the actuating rod to a position in which the plurality of projections of the actuating rod is aligned with the plurality of positioning balls when the outer end of the actuating rod is not pressed. When the outer end of the actuating rod is pressed, each of the plurality of positioning balls is partially received in one of the plurality of recesses.

When it is desired to wind the hose, a user rotates the handle in a direction in which the second rectilinear surfaces of the connecting shaft press against the first rectilinear surfaces of the rotating shaft. Thus, rotation of the handle causes rotation of the arm, the connecting shaft, the rotating shaft, the second transmission wheel, the transmission belt, the first transmission wheel, and the rotating wheel, thereby winding the hose around the rotating wheel. Since the second transmission wheel and the handle are in a higher position, the user can operate easily.

When the hose is pulled away from the frame, the rotating wheel is rotated, which, in turn, causes the second transmission wheel, the first transmission wheel, the rotating shaft, the connecting shaft, and the arm to rotate in a reverse direction associated with the first inclined surfaces of the rotating shaft and the second inclined surfaces of the connecting shaft. In a case that the handle encounters a human body and, thus, creates a torque which make the second inclined surfaces of the connecting shaft press against the first inclined surfaces of the rotating shaft, moving the connecting shaft away from the rotating shaft along the longitudinal axis of the rotating shaft. Thus, the connecting shaft disengages from the rotating shaft. As a result, the connecting shaft, the arm, and the handle will not rotate together with the rotating shaft, preventing injury to the human body resulting from impact from the arm or the handle. The use safety is, thus, improved.

The present invention will become clearer in light of the following detailed description of illustrative embodiments of this invention described in connection with the drawings.

DESCRIPTION OF THE DRAWINGS

FIG. 3A is an enlarged view of a circled portion of FIG. 3.

DETAILED DESCRIPTION OF THE INVENTION

Figure 1:
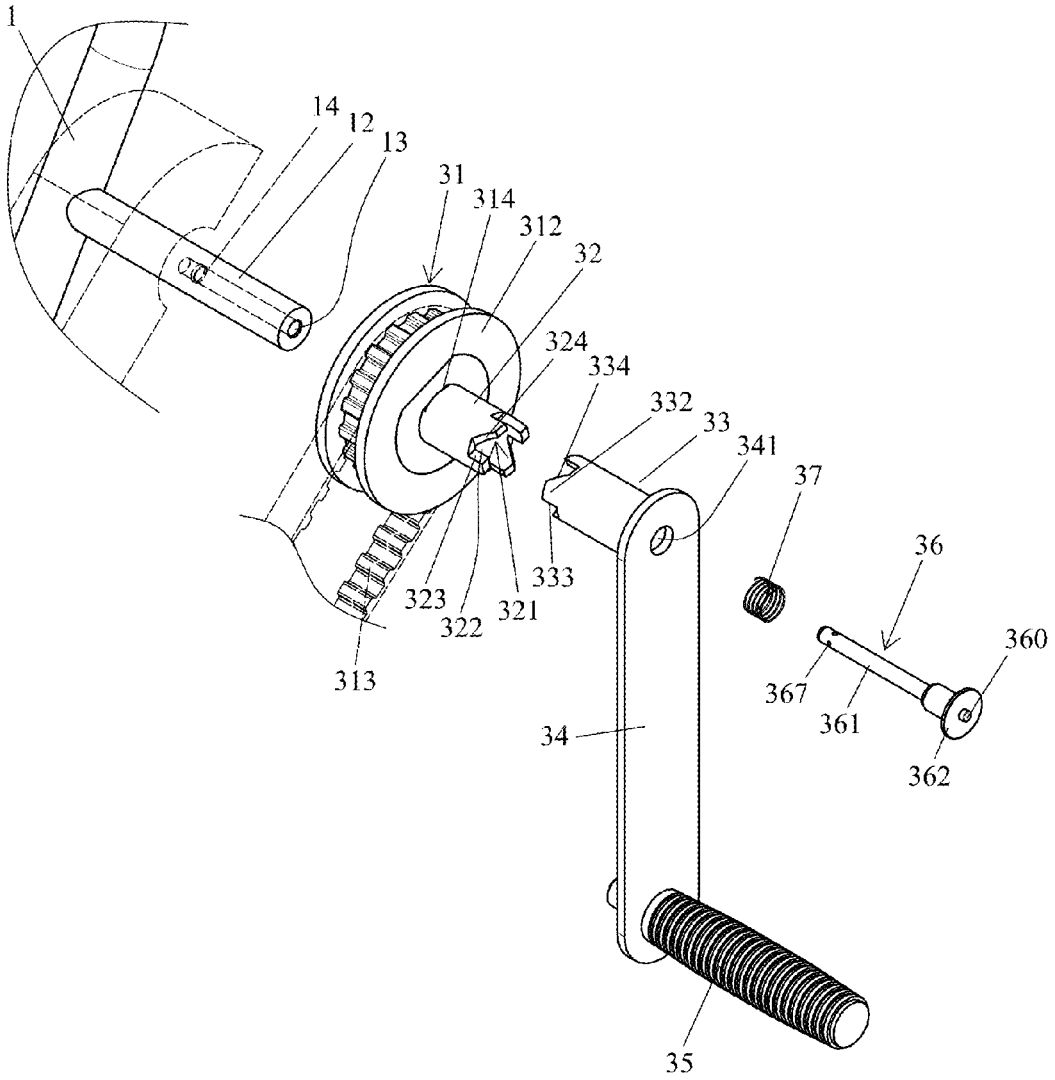
FIG. 1 is a partial, perspective view of a hose winding device according to the present invention.

With reference to FIGS. 1-4, a hose winding device according to the present invention includes a frame 1, a rotating wheel 2, and a handle transmission unit 3. The frame 1 is adapted to be mounted on the ground and includes an axle 12 on a side thereof. The axle 12 of the frame 1 including a receptacle 13 having an inner periphery with a retaining groove 14.

The rotating wheel 2 includes a shaft 21 rotatably mounted to the frame 1. A hose 4 is adapted to be wound around the rotating wheel 2. The rotating wheel 2 is rotated when the hose 4 is pulled outward.

The handle transmission unit 3 is connected to and jointly rotatable with the rotating wheel 2. In this embodiment, the handle transmission unit 3 includes a transmission wheel device 31, a rotating shaft 32, a connecting shaft 33, an arm 34, a handle 35, a connecting rod 36, and an elastic element 37. The transmission wheel device 31 includes a first transmission wheel 311, a second transmission wheel 312, and a transmission belt 313. The first transmission wheel 311 is coupled to and jointly rotatable with the shaft 21 of the rotating wheel 2. The second transmission wheel 312 is mounted above the first transmission wheel 311 and is coupled to and jointly rotatable with the rotating shaft 32. The second transmission wheel 312 includes a connecting hole 314 in a central portion thereof. The transmission belt 313 is mounted around the first and second transmission wheels 311 and 312 to permit joint rotation of the first and second transmission wheels 311 and 312.

The rotating shaft 32 is connected to and jointly rotatable with the axle 21 of the rotating wheel 2. In this embodiment, the rotating shaft 32 includes a through-hole 321 in a central portion thereof. The axle 12 of the frame 1 is received in the through-hole 321 of the rotating shaft 32. The rotating shaft 32 is received in the connecting hole 314 of the second transmission wheel 312 and is jointly rotatable with the second transmission wheel 312. The rotating shaft 32 includes an end having a plurality of engaging grooves 322 annularly spaced from each other. Each engaging groove 322 includes a first rectilinear surface 323 extending in a direction parallel to a longitudinal axis of the rotating shaft 32. Each engaging groove 322 further includes a first inclined surface 324 opposite to the first rectilinear surface 323.

The connecting shaft 33 is coaxially mounted to an outer side of the rotating shaft 32 and includes a through-hole 331 in a central portion thereof receiving the axle 12 of the frame 1. The connecting shaft 33 includes an inner end having a plurality of protrusions 332 annularly spaced from each other. The protrusions 332 can couple with the engaging grooves 322. Each protrusion 332 includes a second rectilinear surface 333 extending in a direction parallel to the longitudinal axis of the rotating shaft 32 and corresponding to one of the first rectilinear surface 323. Each protrusion 332 further includes a second inclined surface 334 opposite to the second rectilinear surface 333 and corresponding to one of the first inclined surfaces 324.

The arm 34 includes a first end fixed to and extending substantially perpendicularly to an outer end of the connecting shaft 33. The arm 34 includes a through-hole 341 defined in a central portion thereof and aligned with the through-hole 331 of the connecting shaft 33. The arm 34 further includes a second end fixed to the handle 35 which extends substantially perpendicularly to the arm 34.

Figure 3:
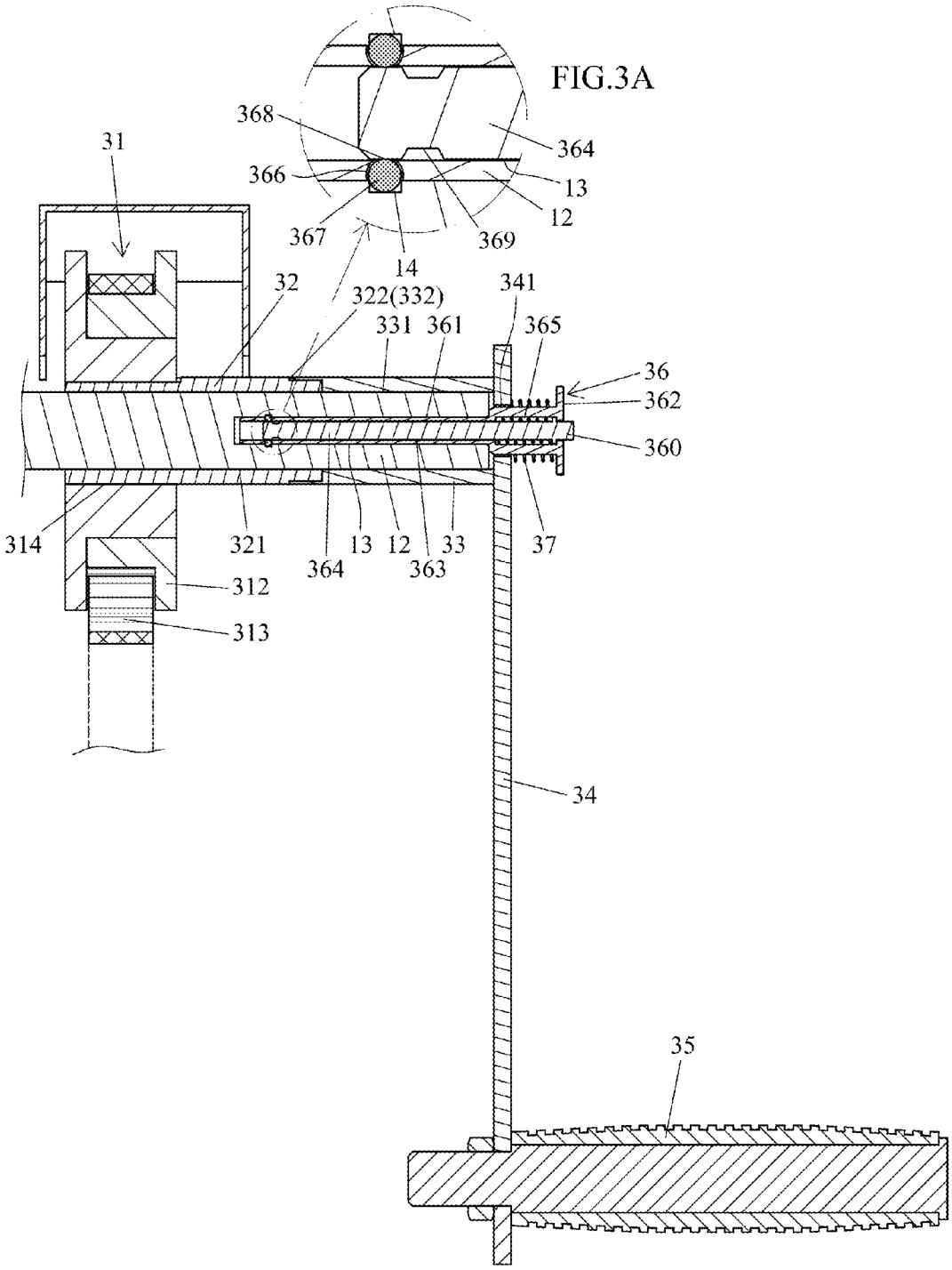
FIG. 3 is a cross sectional view taken along section line A-A of FIG. 2.

The connecting rod 36 is configured to securely couple the through-holes 321 and 331 of the rotating shaft 32 and the connecting shaft 33 with the axle 12. In this embodiment, the connecting rod 36 includes a housing 361 having a receiving hole 363 in a central portion thereof. The connecting rod 36 further includes an outer end having a stopper portion 362 with an outer diameter larger than a diameter of the through-hole 341 of the arm 34. An actuating rod 364 and a spring 365 are mounted in the receiving hole 363. The housing 361 includes an outer periphery having a plurality of grooves 366. A plurality of positioning balls 367 is respectively received in the plurality of grooves 366 of the housing 361. The actuating rod 364 includes an inner end having a plurality of projections 368 and a plurality of recesses 369 for receiving the positioning balls 367. The actuating rod 364 further includes an outer end 360 located outside of the housing 361. The spring 365 biases the actuating rod 364 to a position in which the projections 368 of the actuating rod 364 are aligned with the positioning balls 367 when the outer end 360 of the actuating rod 364 is not pressed, as shown in FIG. 3. When the outer end 360 of the actuating rod 364 is pressed, each positioning ball 367 is partially received in one of the recesses 369.

The first end of the arm 34 is located between the axle 12 and the stopper portion 366. The elastic element 37 is mounted around the connecting rod 36 and is located between the stopper portion 366 and the first end of the arm 34. The elastic element 37 biases the protrusions 332 of the connecting shaft 33 to engage with the engaging grooves 322 of the rotating shaft 32, permitting joint rotation of the connecting shaft 33 and the rotating shaft 32 in a first direction. The connecting shaft 33 moves along the longitudinal axis of the rotating shaft 32 when the first and second inclined surfaces 324 and 334 are subjected to a torque in a second direction reverse to the first direction, and the protrusions 332 of the connecting shaft 33 disengage from the engaging grooves 322 of the rotating shaft 32.

In assembly of the handle transmission unit 3, the second transmission wheel 312 is coupled with the rotating shaft 32, and the rotating shaft 32 is mounted around the axle 12. The connecting shaft 33 is mounted around the axle 12. The outer end 360 of the connecting rod 36 can be pressed to align the recesses 369 with the retaining groove 14, such that each positioning ball 367 is partially received in one of the recesses 369. The inner end of the connecting rod 36 extends through the elastic element 37, the through-hole 341 of the arm 34, and the receptacle 13 of the axle 12. Then, the outer end 360 of the connecting rod 36 is released, and the protrusions 368 press against the positioning balls 367 to engage with the retaining groove 14 in the inner periphery of the axle 12. Thus, no tools are required during the assembly, and the assembly is easy.

Figure 2:
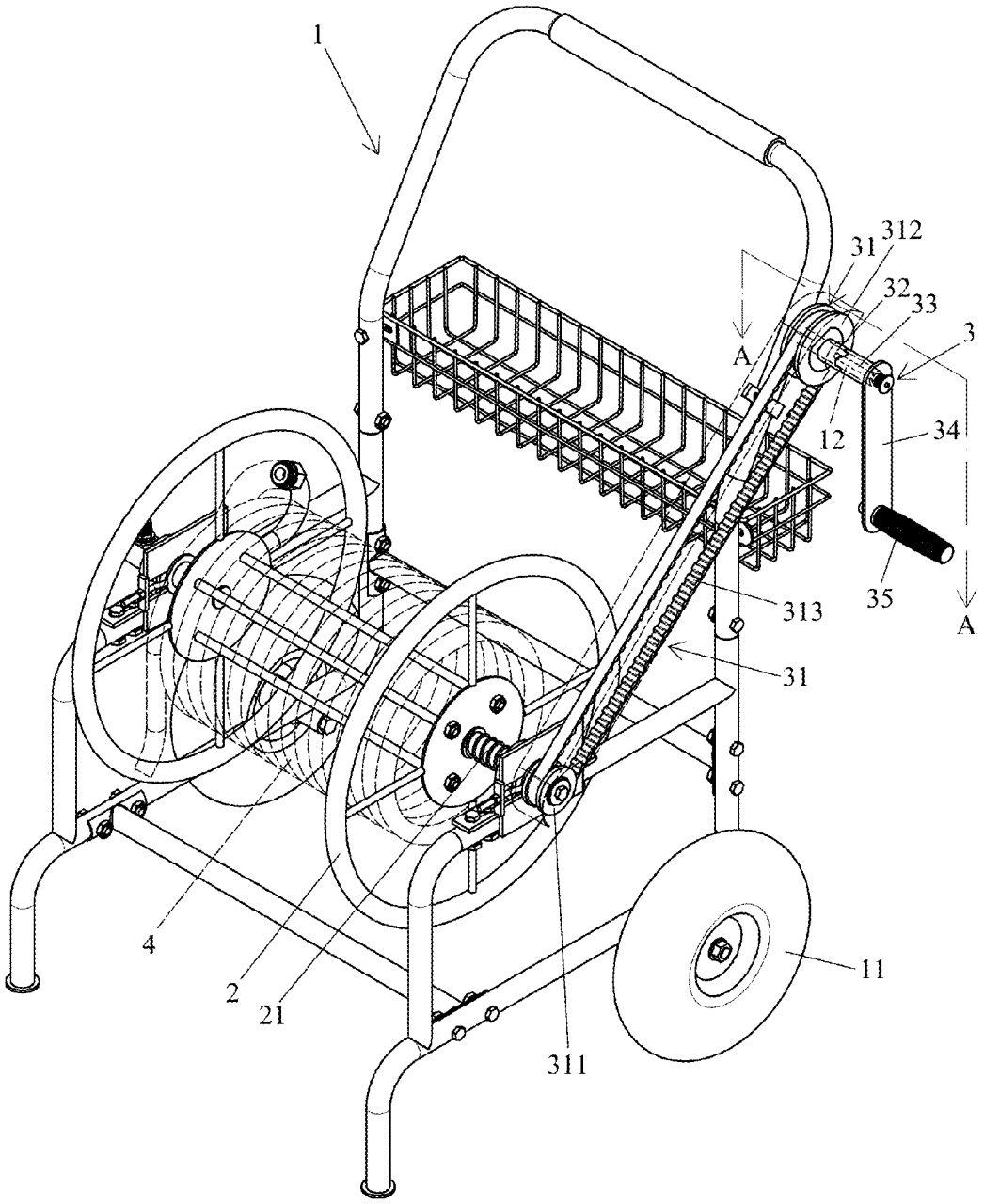
FIG. 2 is a perspective view of the hose winding device according to the present invention.
Figure 4:
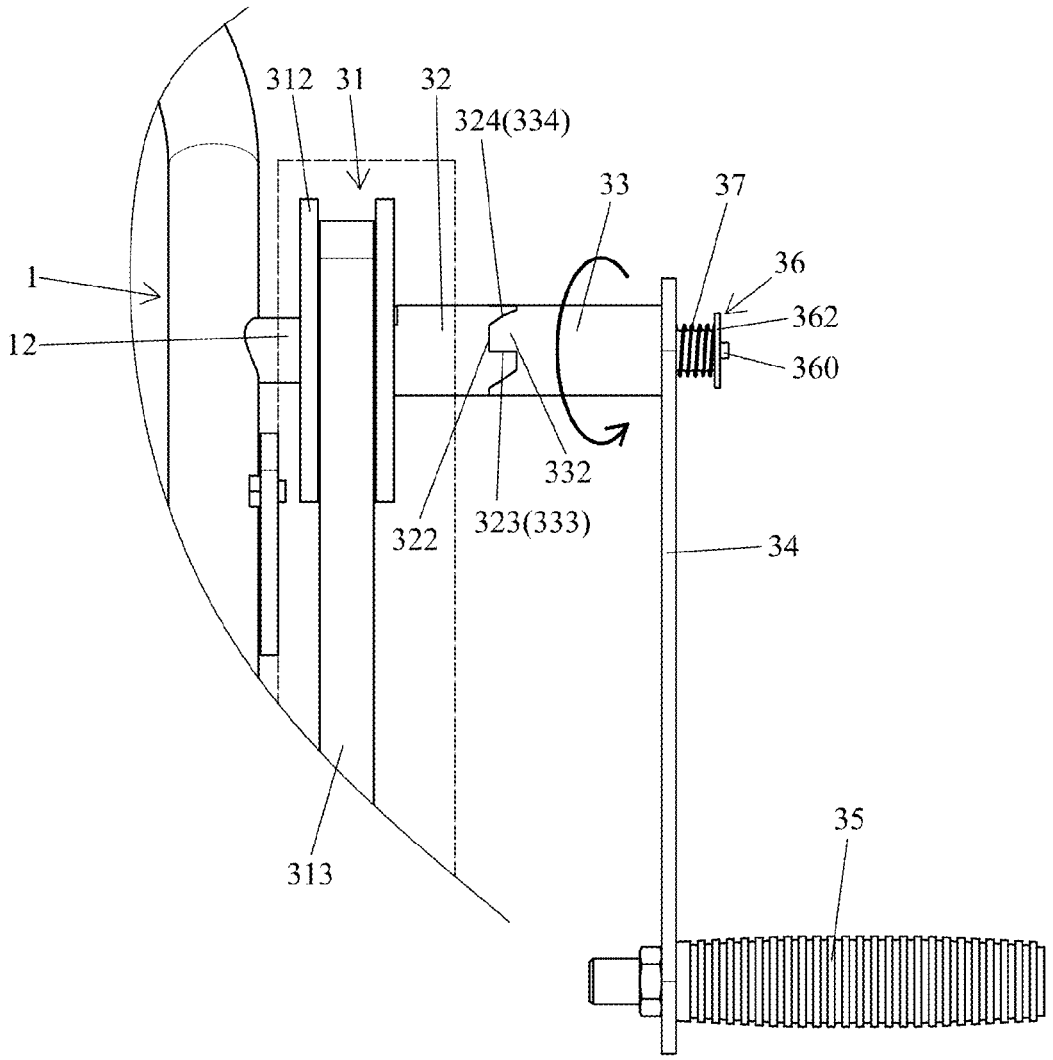
FIG. 4 is a schematic view of a portion of the hose winding device according to the present invention, illustrating a hose winding operation.

With reference to FIGS. 2 and 4, when it is desired to wind the hose 4, a user rotates the handle 35 in a direction in which the second rectilinear surfaces 333 of the connecting shaft 33 press against the first rectilinear surfaces 323 of the rotating shaft 32. Thus, rotation of the handle 35 causes rotation of the arm 34, the connecting shaft 33, the rotating shaft 32, the second transmission wheel 312, the transmission belt 313, the first transmission wheel 311, and the rotating wheel 2, thereby winding the hose 4 around the rotating wheel 2. Since the second transmission wheel 312 and the handle 35 are in a higher position, the user can operate easily.

Figure 5:
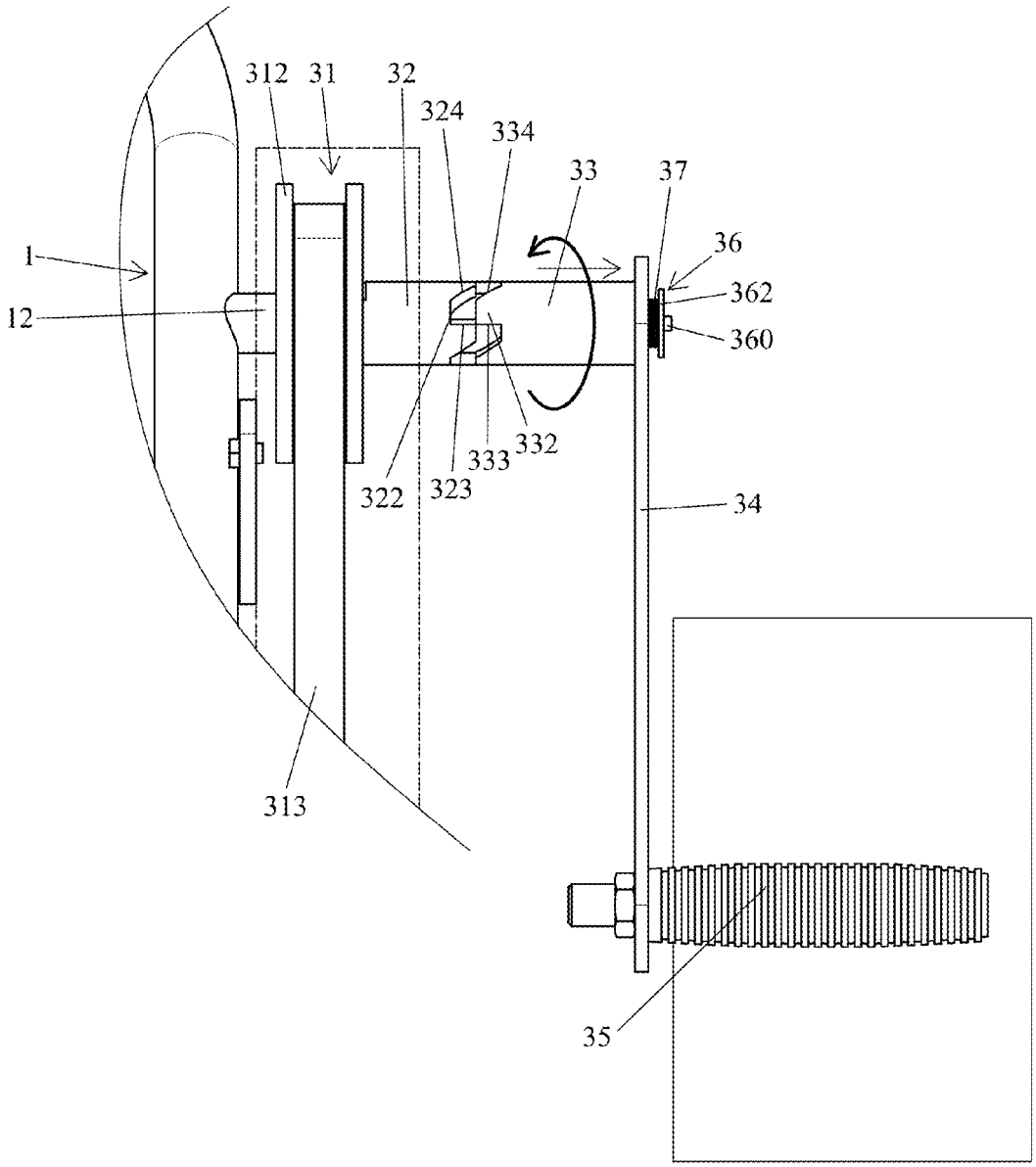
FIG. 5 is a view similar to FIG. 1, with a hose pulled outward and with a handle pressing against a human body.

With reference to FIGS. 1, 2, and 5, when the hose 4 is pulled away from the frame 1, the rotating wheel 2 is rotated, which, in turn, causes the second transmission wheel 312, the first transmission wheel 311, the rotating shaft 32, the connecting shaft 33, and the arm 34 to rotate in a reverse direction associated with the first inclined surfaces 324 of the rotating shaft 32 and the second inclined surfaces 334 of the connecting shaft 33. In a case that the handle 35 encounters a human body standing in a position shown by the block in FIG. 5 and, thus, creates a torque which make the second inclined surfaces 334 of the connecting shaft 33 press against the first inclined surfaces 324 of the rotating shaft 33, moving the connecting shaft 33 away from the rotating shaft 32 along the longitudinal axis of the rotating shaft 32. Thus, the connecting shaft 33 disengages from the rotating shaft 32. As a result, the connecting shaft 33, the arm 34, and the handle 35 will not rotate together with the rotating shaft 32, preventing injury to the human body resulting from impact from the arm 34 or the handle 35. The use safety is, thus, improved.

Although specific embodiments have been illustrated and described, numerous modifications and variations are still possible without departing from the scope of the invention. The scope of the invention is limited by the accompanying claims.

The invention claimed is:

1. A hose winding device comprising:

a frame adapted to be mounted on a ground, with the frame including an axle;

a rotating wheel including a shaft rotatably mounted to the frame, with a hose adapted to be wound around the rotating wheel, wherein the rotating wheel is rotated when the hose is pulled outward;

a handle transmission unit connected to and jointly rotatable with the rotating wheel, with the handle transmission unit including a rotating shaft, a connecting shaft, an arm, a handle, a connecting rod, and an elastic element, with the rotating shaft including a through-hole, with the axle of the frame received in the through-hole of the rotating shaft, with the rotating shaft connected to and jointly rotatable with an axle of the rotating wheel, with the rotating shaft including an end having a plurality of engaging grooves annularly spaced from each other, with each of the plurality of engaging grooves including a first rectilinear surface extending in a direction parallel to a longitudinal axis of the rotating shaft, with each of the plurality of engaging grooves further including a first inclined surface opposite to the first rectilinear surface, with the connecting shaft coaxially mounted to an outer side of the rotating shaft and including a through-hole receiving the axle of the frame, with the connecting shaft including an inner end having a plurality of protrusions annularly spaced from each other, with each of the plurality of protrusions including a second rectilinear surface extending in a direction parallel to the longitudinal axis of the rotating shaft and corresponding to one of the plurality of engaging grooves, with each of the plurality of protrusions further including a second inclined surface opposite to the second rectilinear surface and corresponding to one of the plurality of first inclined surfaces, with the arm including a first end fixed to the connecting shaft and a second end fixed to the handle, with the connecting rod configured to securely couple the through-holes of the rotating shaft and the connecting shaft with the axle, with the elastic element biasing the plurality of protrusions of the connecting shaft to engage with the plurality of engaging grooves of the rotating shaft, permitting joint rotation of the connecting shaft and the rotating shaft in a first direction, and wherein the connecting shaft moves along the longitudinal axis of the rotating shaft when the first and second inclined surfaces are subjected to a torque in a second direction reverse to the first direction, and the plurality of protrusions of the connecting shaft disengages from the plurality of engaging grooves of the rotating shaft.

2. The hose winding device as claimed in claim 1, with the connecting rod including an inner end coupled with the axle of the frame, with the connecting rod further including an outer end having a stopper portion, with the first end of the arm located between the axle and the stopper portion, and with the elastic element mounted around the connecting rod and located between the stopper portion and the first end of the arm.

3. The hose winding device as claimed in claim 2, with the axle of the frame including a receptacle having an inner periphery with a retaining groove, with the connecting rod including a plurality of positioning balls, with the inner end of the connecting rod received in the receptacle, and with the plurality of positioning balls coupled in the retaining groove.

4. The hose winding device as claimed in claim 1, with the handle transmission unit further including a first transmission wheel, a second transmission wheel, and a transmission belt, with the first transmission wheel coupled to and jointly rotatable with the shaft of the rotating wheel, with the second transmission wheel mounted above the first transmission wheel and coupled to and jointly rotatable with the rotating shaft, and with the transmission belt mounted around the first and second transmission wheels to permit joint rotation of the first and second transmission wheels.

5. The hose winding device as claimed in claim 1, with the first end of the arm extending substantially perpendicularly to an outer end of the connecting shaft, with the arm including a through-hole aligned with the through-hole of the connecting shaft, with the connecting rod including a housing having a receiving hole, with the connecting rod further including an outer end having a stopper portion with an outer diameter larger than a diameter of the through-hole of the arm, with an actuating rod and a spring mounted in the receiving hole, with the housing including an outer periphery having a plurality of grooves, with a plurality of positioning balls respectively received in the plurality of grooves of the housing, with the actuating rod including an inner end having a plurality of projections and a plurality of recesses for receiving the plurality of positioning balls, with the actuating rod further including an outer end located outside of the housing, with the spring biasing the actuating rod to a position in which the plurality of projections of the actuating rod is aligned with the plurality of positioning balls when the outer end of the actuating rod is not pressed, and wherein when the outer end of the actuating rod is pressed, each of the plurality of positioning balls is partially received in one of the plurality of recesses.

* * * * *